US008379890B2

(12) United States Patent
Kuo et al.

(10) Patent No.: US 8,379,890 B2
(45) Date of Patent: Feb. 19, 2013

(54) CAPACITIVE ELECTRO-ACOUSTIC TRANSDUCTION SYSTEM AND CAPACITIVE ELECTRO-ACOUSTIC TRANSDUCER THEREOF

(75) Inventors: Yien-Chun Kuo, Taoyuan County (TW); Fang-Ching Lee, Taoyuan County (TW); Cheng-Chieh Chuang, Taoyuan County (TW)

(73) Assignee: HTC Corporation, Taoyuan, Taoyuan County (TW)

( * ) Notice: Subject to any disclaimer, the term of this patent is extended or adjusted under 35 U.S.C. 154(b) by 248 days.

(21) Appl. No.: 12/979,374

(22) Filed: Dec. 28, 2010

(65) Prior Publication Data

US 2011/0311082 A1 Dec. 22, 2011

(30) Foreign Application Priority Data

Jun. 17, 2010 (TW) ..... 99119731 A

(51) Int. Cl.
*H04R 25/00* (2006.01)

(52) U.S. Cl. ..... 381/190; 381/174; 381/191

(58) Field of Classification Search ..... 381/190, 381/191, 396, 431, 116, 173, 174, 175, 113
See application file for complete search history.

(56) References Cited

U.S. PATENT DOCUMENTS 3,980,838 A * 9/1976 Yakushiji et al. ..... 381/191
5,901,235 A * 5/1999 Thigpen et al. ..... 381/431

FOREIGN PATENT DOCUMENTS

EP 2182737 A1 5/2010

OTHER PUBLICATIONS

Office Action mailed on Jun. 8, 2012 for the German application No. 102011050924.0, filing date Jun. 8, 2011, p. 1-10.

* cited by examiner

*Primary Examiner* — Andrew C Flanders
*Assistant Examiner* — Sunita Joshi
(74) *Attorney, Agent, or Firm* — Winston Hsu; Scott Margo

(57) ABSTRACT

A capacitive electro-acoustic transducer includes a pair of input terminals, a pair of output terminals, an electrode plate, and a diaphragm. The pair of input terminals receives an audio signal, and the pair of output terminals outputs the audio signal, wherein at least one terminal of these terminals is a conductive magnet. The electrode plate has a first end and a second end electrically connected to a first input terminal of the pair of input terminals and a first output terminal of the pair of output terminals, respectively. The diaphragm is disposed on one side of the electrode plate and has a third end and a fourth end electrically connected to a second input terminal of the pair of input terminals and a second output terminal of the pair of output terminals, respectively.

17 Claims, 7 Drawing Sheets

CAPACITIVE ELECTRO-ACOUSTIC TRANSDUCTION SYSTEM AND CAPACITIVE ELECTRO-ACOUSTIC TRANSDUCER THEREOF

BACKGROUND OF THE INVENTION

1. Field of the Invention

The present disclosure relates to a capacitive electro-acoustic transducer and a capacitive electro-acoustic transduction system, and more particularly, to a system and its capacitive electro-acoustic transducer(s) for connecting terminals of a plurality of capacitive electro-acoustic transducer by using a conductive magnet.

2. Description of the Prior Art

A traditional dynamic coil speaker system usually has an inductive architecture. As can be known by reference to the impedance formula of an inductor, a resultant impedance of two identical dynamic coil speakers connected in parallel will become one-half of the impedance value of the original single dynamic speaker, such that the current load of the audio driver will be increased to double. Similarly, a resultant impedance of N identical dynamic coil speakers connected in parallel will become one-Nth of the impedance value of the original single dynamic speaker, such that the current load of the audio driver will be increased to N times, which will likely result in the audio driver burning down.

Hence, in the traditional dynamic coil speaker system, it is not recommended to connect several dynamic speakers in parallel unless a resultant impedance of these dynamic speakers is fine-tuned in advance to forma suitable speaker array (having a resultant impedance of about 4-8 ohms).

SUMMARY OF THE INVENTION

It is one of the objectives of the present disclosure to provide a capacitive electro-acoustic transduction system and related capacitive electro-acoustic transducer(s) for transmitting audio signals between a plurality of capacitive electro-acoustic transducers by using the conductivity and the magnetic attraction of conductive magnets in order to achieve a goal of connecting the plurality of capacitive electro-acoustic transducers in parallel.

According to one aspect of the present disclosure, a capacitive electro-acoustic transducer is provided. The capacitive electro-acoustic transducer may include a pair of input terminals and a pair of output terminals, an electrode plate, and a diaphragm. The pair of input terminals is used for receiving an audio signal and the pair of output terminals is used for outputting the audio signal, wherein at least one terminal of the pair of input terminals and the pair of output terminals is a conductive magnet. The electrode plate includes a first end and a second end, wherein the first end is electrically connected to a first input terminal of the pair of input terminals, and the second end is electrically connected to a first output terminal of the pair of the output terminals. The diaphragm is disposed on a first side of the electrode plate and may include a third end and a fourth end, wherein the third end is electrically connected to a second input terminal of the pair of input terminals, and the fourth end is electrically connected to a second output terminal of the pair of the output terminals.

According to another aspect of the present disclosure, a capacitive electro-acoustic transduction system is provided. The capacitive electro-acoustic transduction system may include an audio driver, a first capacitive electro-acoustic transducer and a second capacitive electro-acoustic transducer. The audio driver is configured to output an audio signal. Each of the first capacitive electro-acoustic transducer and the second capacitive electro-acoustic transducer may include a pair of input terminals and a pair of output terminals, an electrode plate, and a first diaphragm. The pair of input terminals is used for receiving the audio signal and the pair of output terminals is used for outputting the audio signal, wherein at least one terminal of the pair of input terminals and the pair of output terminals is a conductive magnet. The electrode plate may include a first end and a second end, wherein the first end is electrically connected to a first input terminal of the pair of input terminals, and the second end is electrically connected to a first output terminal of the pair of the output terminals. The first diaphragm is disposed on a first side of the electrode plate and may include a third end and a fourth end, wherein the third end is electrically connected to a second input terminal of the pair of input terminals, and the fourth end is electrically connected to a second output terminal of the pair of output terminals. The pair of input terminals of the first capacitive electro-acoustic transducer is electrically connected to the audio driver for receiving the audio signal, and the pair of output terminals of the first capacitive electro-acoustic transducer is electrically connected to the pair of input terminals of the second capacitive electro-acoustic transducer via the magnetic attraction of the conductive magnet.

These and other objectives of the present invention will no doubt become obvious to those of ordinary skill in the art after reading the following detailed description of the preferred embodiment that is illustrated in the various figures and drawings.

DETAILED DESCRIPTION

First, in order to make the specification of the present disclosure easier to understand, a brief description of characteristics of a capacitive electro-acoustic transducer is given. A common capacitive electro-acoustic transducer, such as an electrostatic speaker, an electret speaker, a piezoelectric speaker, or an electret earphone, usually has a capacitive architecture. As can be known by reference to the capacitor's impedance formula, a resultant impedance of two identical capacitive electro-acoustic transducers connected in parallel will become twice the impedance value of the original single capacitive electro-acoustic transducer. Similarly, a resultant impedance of N identical capacitive electro-acoustic transducers connected in parallel will become N times the impedance value of the original single capacitive electro-acoustic transducer, such that the current load of the audio driver will be decreased to one-Nth of the current load of the original single capacitive electro-acoustic transducer, which will not increase the current load of the audio driver and will not cause the audio driver to burn down. Therefore, a capacitive electro-acoustic transducer and its audio connecting manner are disclosed in the present disclosure by applying the characteristics of the capacitive electro-acoustic transducer. The capacitive electro-acoustic transducer is able to connect to the audio driver via terminals (which may be implemented by a conductive magnet); furthermore, a plurality of capacitive electro-acoustic transducers can be connected in parallel via terminals.

Figure 1:
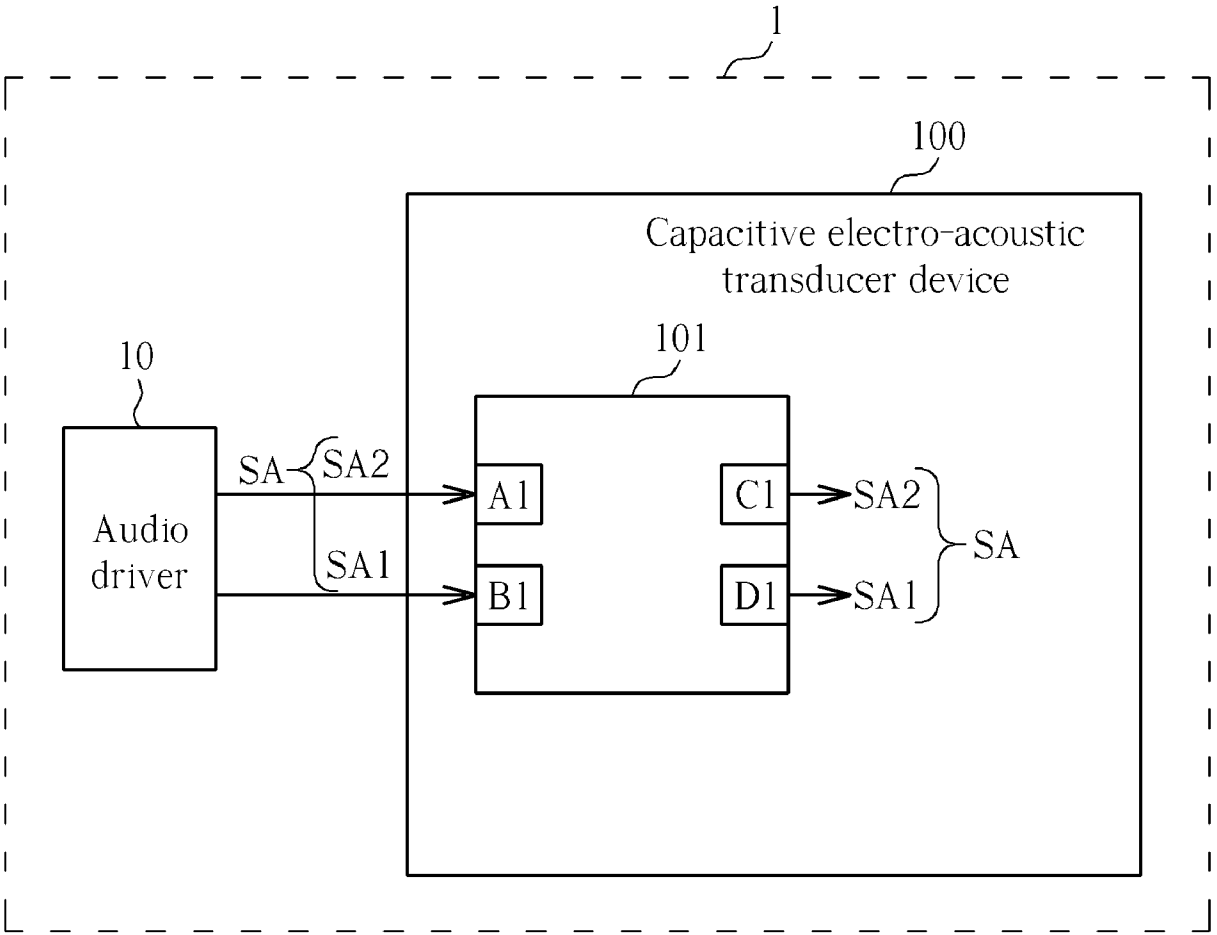
FIG. 1 is a diagram of a capacitive electro-acoustic transduction system according to a first embodiment of the present disclosure.

Please refer to FIG. 1. FIG. 1 is a diagram of a capacitive electro-acoustic transduction system 1 according to a first embodiment of the present disclosure. In this embodiment, the capacitive electro-acoustic transduction system 1 may include a capacitive electro-acoustic transducer device 100 and an audio driver 10. The capacitive electro-acoustic transducer device 100 may include at least one capacitive electro-acoustic transducer 101, but the present disclosure is not limited to this only. The capacitive electro-acoustic transducer device 100 is coupled to the audio driver 10, and the audio driver 10 may output an audio signal SA to drive the capacitive electro-acoustic transducer device 100. As shown in FIG. 1, the capacitive electro-acoustic transducer 101 may include a plurality of terminals A1, B1, C1, and D1, wherein each terminal of the plurality of terminals A1, B1, C1, and D1 can selectively be used as an input terminal or an output terminal. In this embodiment, the input/output characteristics of these terminals can be represented by directions of the arrows. For example, the terminals A1 and B1 may be used as a pair of input terminals being electrically connected to the audio driver 10 for receiving the audio signal SA; and the terminals C1 and D1 may be used as a pair of output terminals for outputting the audio signal SA. In other embodiments, the terminals A1 and B1 may be used as a pair of output terminals, and the terminals C1 and D1 may be used as a pair of input terminals, which also belongs to the scope of the present disclosure.

It should be noted that: at least one terminal of the pair of input terminals (including the terminals A1 and B1) and the pair of output terminals (including the terminals C1 and D1) of the capacitive electro-acoustic transducer 101 is a conductive magnet. Preferably, each terminal of the plurality of terminals A1, B1, C1, and D1 is a conductive magnet.

Figure 2A:
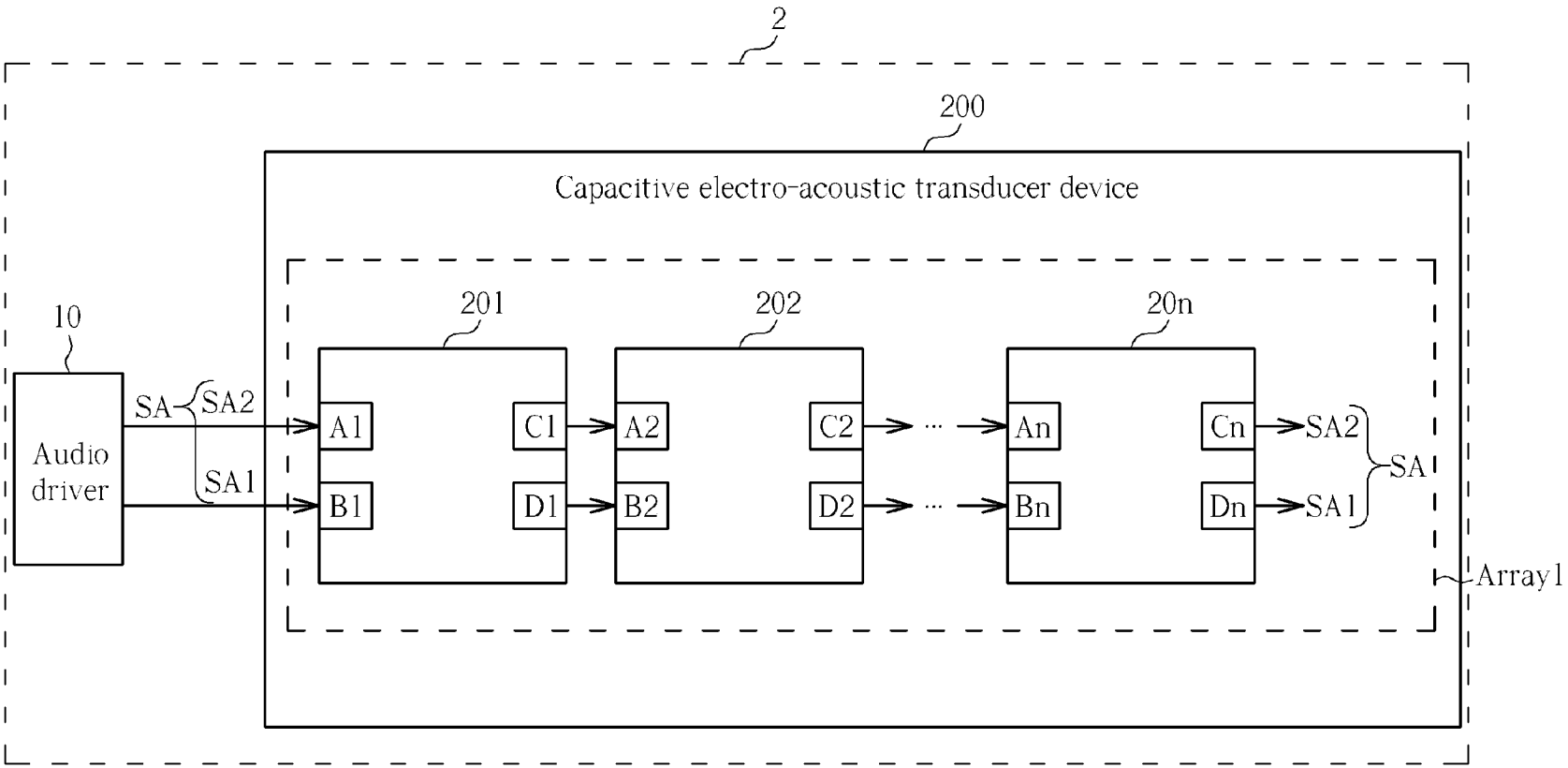
FIG. 2*a* is a diagram of a capacitive electro-acoustic transduction system according to a second embodiment of the present disclosure.

Please refer to FIG. 2*a*. FIG. 2*a* is a diagram of a capacitive electro-acoustic transduction system 2 according to a second embodiment of the present disclosure. In this embodiment, the capacitive electro-acoustic transduction system 2 includes a capacitive electro-acoustic transducer device 200 and an audio driver 10. The capacitive electro-acoustic transducer device 200 is coupled to the audio driver 10, and the audio driver 10 may output an audio signal SA to drive the capacitive electro-acoustic transducer device 200. The capacitive electro-acoustic transducer device 200 may include a plurality of capacitive electro-acoustic transducers 201, 202, . . . , and 20*n*. Each of the capacitive electro-acoustic transducers 201, 202, . . . , and 20*n* may include a plurality of terminals, wherein the plurality of capacitive electro-acoustic transducers 201, 202, . . . , and 20*n* connect to each other via the plurality of terminals. Please note that each terminal of the plurality of terminals can selectively be used as an input terminal or an output terminal. In this embodiment, the input/output characteristics of these terminals can be represented by directions of the arrows. For example, the capacitive electro-acoustic transducer 201 may include a plurality of terminals A1~D1, wherein the terminals A1 and B1 may be used as a pair of input terminals of the capacitive electro-acoustic transducer 201, which is electrically connected to the audio driver 10 for receiving the audio signal SA, and the terminals C1 and D1 may be used as a pair of output terminals of the capacitive electro-acoustic transducer 201; the capacitive electro-acoustic transducer 202 may include a plurality of terminals A2~D2, wherein the terminals A2 and B2 may be used as a pair of input terminals of the capacitive electro-acoustic transducer 202, and the terminals C2 and D2 may be used as a pair of output terminals of the capacitive electro-acoustic transducer 202, etc.

Figure 2B:
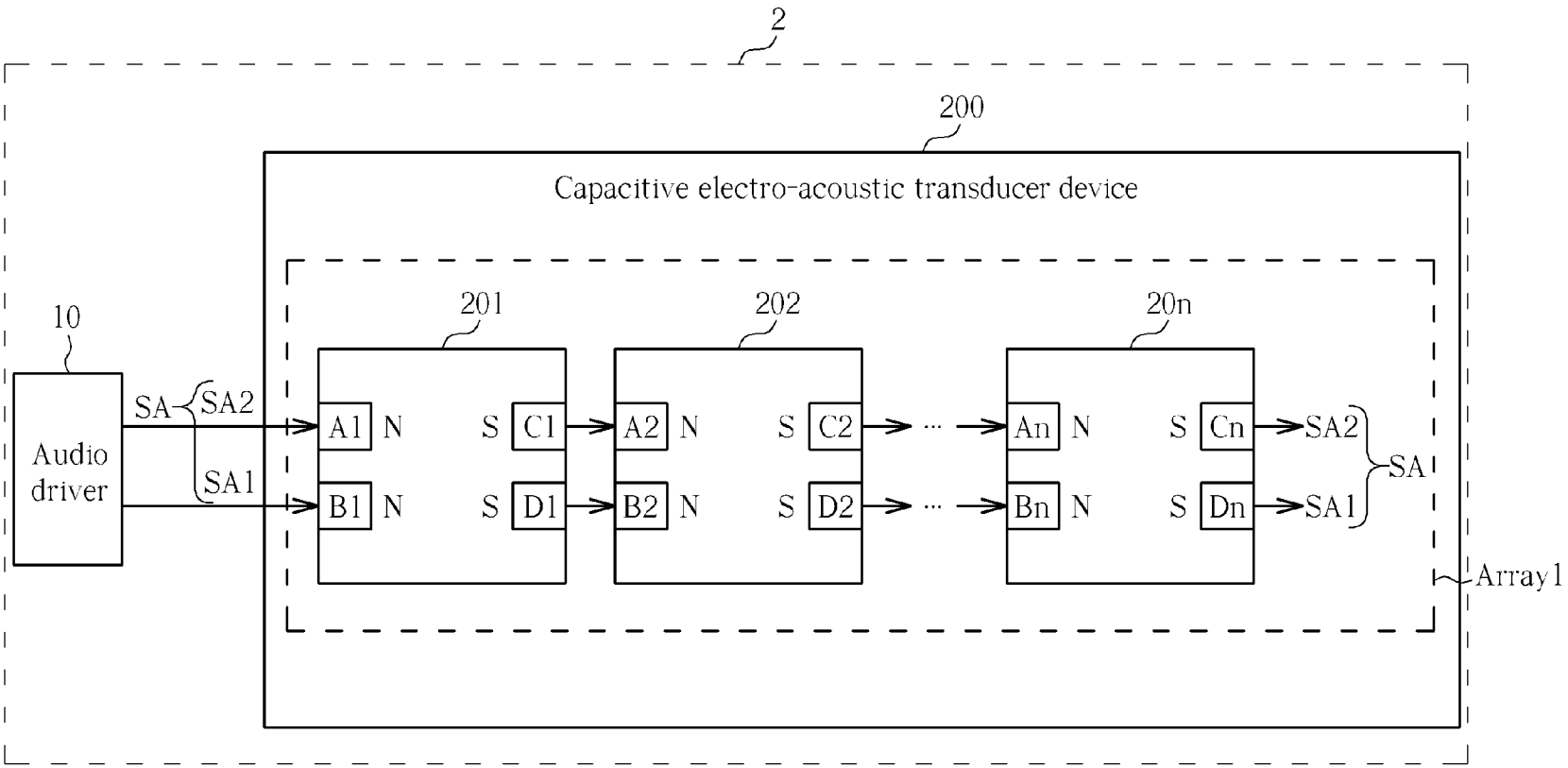
FIG. 2*b* is a diagram showing a magnet configuration of the capacitive electro-acoustic transduction system shown in FIG. 2*a*.
Figure 2C:
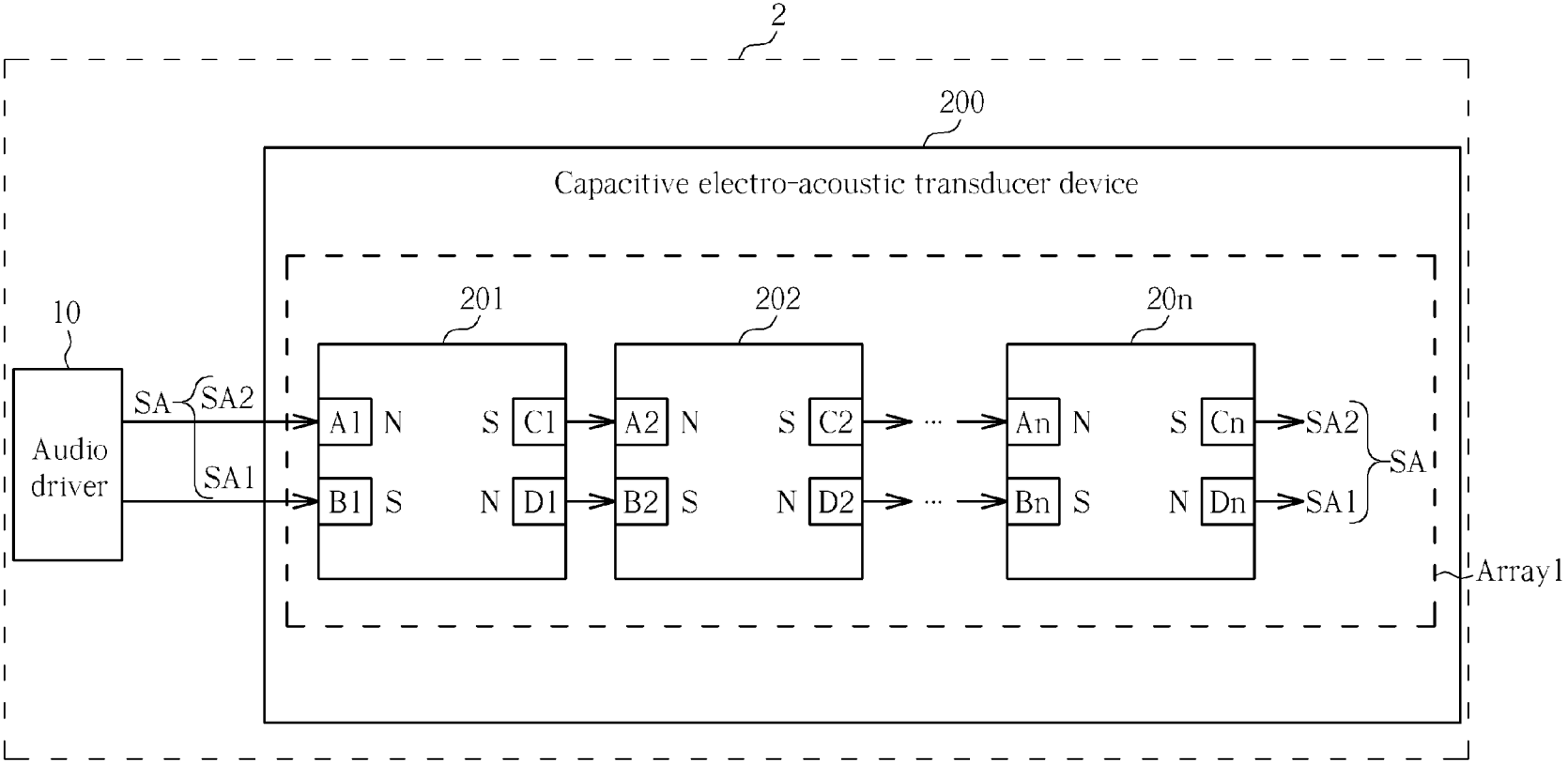
FIG. 2*c* is a diagram showing another magnet configuration of the capacitive electro-acoustic transduction system shown in FIG. 2*a*.

It should be noted that at least one pair of terminals of each capacitive electro-acoustic transducer 201~20*n* is a conductive magnet, respectively. Preferably, each terminal of the plurality of terminals A1~D1, A2~D2, . . . , and An~Dn is a conductive magnet. Therefore, the audio signal can be transmitted between the plurality of capacitive electro-acoustic transducers 201~20*n* by using the conductivity and the magnetic attraction of conductive magnets in order to achieve a goal of connecting the plurality of capacitive electro-acoustic transducers 201~20*n* in parallel. As an illustration, each of the input terminals Al~B1, A2~B2, . . . , and An~Bn of the plurality of capacitive electro-acoustic transducers 201~20*n* is a conductive magnet with a first magnetic pole (e.g., N pole), and each of the output terminals C1~D1, C2~D2, . . . , and Cn~Dn of the plurality of capacitive electro-acoustic transducers 201~20*n* is a conductive magnet with a second magnetic pole (e.g., S pole), such that the plurality of capacitive electro-acoustic transducers 201~20*n* can be connected to each other and transmit the audio signal between them via the conductive magnets, as is also shown in FIG. 2*b*. For a further illustration, please refer to FIG. 2*c*, showing each of the terminals A1, D1, A2, D2, . . . , and An and Dn of the plurality of capacitive electro-acoustic transducers 201~20*n* is a conductive magnet with a first magnetic pole (e.g., N pole), and each of the terminals B1, C1, B2, C2, . . . , and Bn and Cn of the plurality of capacitive electro-acoustic transducers 201~20*n* is a conductive magnet with a second magnetic pole (e.g., S pole), such that the plurality of capacitive electro-acoustic transducers 201~20*n* can be connected to each other and transmit the audio signal between them via the conductive magnets. In other embodiments, each of the input terminals A1~B1, A2~B2, . . . , and An~Bn of the plurality of capacitive electro-acoustic transducers 201~20*n* is a conductive magnet with a magnetic pole (e.g., N pole or S pole), and each of the output terminals C1~D1, C2~D2, . . . , and Cn~Dn of the plurality of capacitive electro-acoustic transducers 201~20*n* is formed by metal material (s) with conductivity and magnetic property. In still another embodiment, each of the input terminals A1~B1, A2~B2, . . . , and An~Bn of the plurality of capacitive electro-acoustic transducers 201~20*n* is formed by metal material(s) with conductivity and magnetic properties, and each of the output terminals C1~D1, C2~D2, . . . , and Cn~Dn of the plurality of capacitive electro-acoustic transducers 201~20*n* is a conductive magnet with a magnetic pole (e.g. an N pole or S pole). All of the abovementioned embodiments can achieve the goal of connecting the plurality of capacitive electro-acoustic transducers 201~20*n* to each other and transmitting the audio signal between them. The abovementioned embodiments are merely an example for illustrating the present disclosure, and in no way should be considered as a limitation of the present disclosure. Those skilled in the art should appreciate that various modifications of the connecting manner and the magnet configuration of the terminals of the plurality of capacitive electro-acoustic transducers 201~20*n* may be made without departing from the spirit of the present disclosure, which can be designed depending on practical demands.

Figure 3:
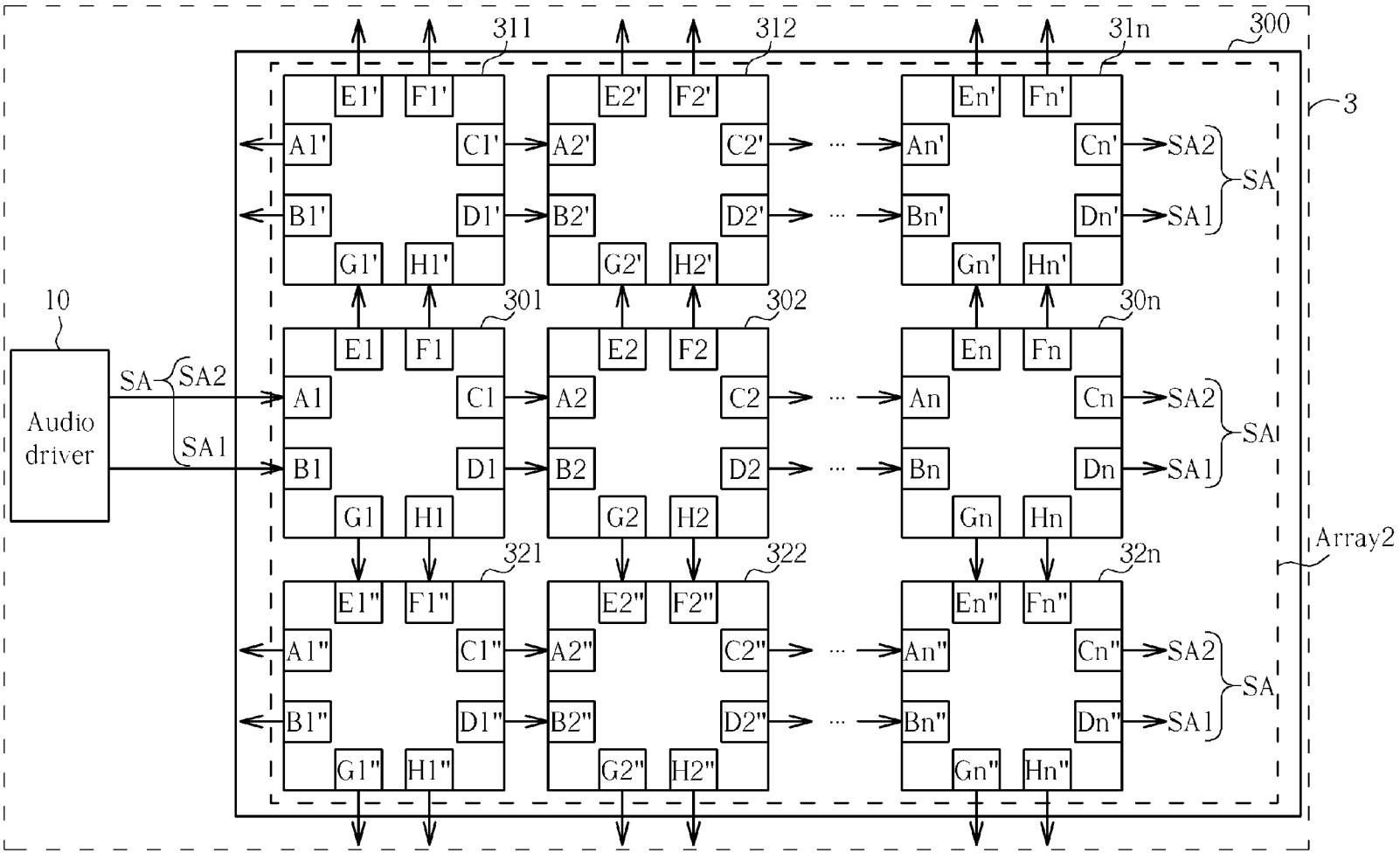
FIG. 3 is a diagram of a capacitive electro-acoustic transduction system according to a third embodiment of the present disclosure.

Please refer to FIG. 3. FIG. 3 is a diagram of a capacitive electro-acoustic transduction system 3 according to a third embodiment of the present disclosure. In this embodiment, the capacitive electro-acoustic transduction system 3 includes a capacitive electro-acoustic transducer device 300 and an audio driver 10. The capacitive electro-acoustic transducer device 300 is coupled to the audio driver 10, and the audio driver 10 may output an audio signal SA to drive the capacitive electro-acoustic transducer device 300. The capacitive electro-acoustic transducer device 300 may include a plurality of capacitive electro-acoustic transducers 301~30*n*, 311~31*n*, and 321~32*n*. Each of the capacitive electro-acoustic transducers 301~30*n*, 311~31*n*, and 321~32*n* may include a plurality of terminals, wherein the plurality of capacitive electro-acoustic transducers 301~30*n*, 311~31*n*, and 321~32*n* are connected to each other via the plurality of terminals. Please note that each terminal of the plurality of terminals can selectively be used as an input terminal or an output terminal. In this embodiment, the input/output characteristics of these terminals can be represented by directions of the arrows. For example, the capacitive electro-acoustic transducer 301 may include a plurality of terminals A1~H1, wherein the terminals A1 and B1 may be used as a pair of input terminals of the capacitive electro-acoustic transducer 301 and are electrically connected to the audio driver 10 for receiving the audio signal SA, and the terminals C1~D1, E1~F1, and G1~H1 may be used as three pairs of output terminals of the capacitive electro-acoustic transducer 301, respectively; the capacitive electro-acoustic transducer 311 may include a plurality of terminals A1'~H1', wherein the terminals G1' and H1' may be used as a pair of input terminals of the capacitive electro-acoustic transducer 311, and the terminals A1'~B1'~C1'~D1', and E1'~F1' may be used as three pairs of output terminals of the capacitive electro-acoustic transducer 301, respectively, etc.

It should be noted that: at least one pair of terminals of each capacitive electro-acoustic transducer 301~30*n*, 311~31*n*, and 321~32*n* is a conductive magnet. Preferably, each terminal of the plurality of terminals A1~H1, A2~H2, . . . , An~Hn, Al'~H1', A2'~H2', . . . , An'~Hn', A1"~H1", A2"~H2", . . . , and An"~Hn" is a conductive magnet, or a part of the terminals may be implemented by conductive magnets, while another part of the terminals may be implemented by metal material(s) with conductivity and magnetic properties. Therefore, the audio signals can be transmitted between the plurality of capacitive electro-acoustic transducers 301~30*n*, 311-31*n*, and 321~32*n* by using the conductivity and the magnetic attraction of conductive magnets in order to achieve a goal of connecting the plurality of capacitive electro-acoustic transducers 301~30*n*, 311~31*n*, and 321~32*n* in parallel. Furthermore, it should be noted that: various modifications of the connecting manner and the magnet configuration of the plurality of terminals A1~H1, A2~H2, . . . , An~Hn, A1'~H1', A2'~H2', . . . , An'~Hn', Al"~H1", A2"~H2", . . . , and An"~Hn" may be made without departing from the spirit of the present disclosure (please refer to the connecting manner and the magnet configuration of the terminals shown in FIG. 2*b* and FIG. 2*c*), and the modifications can be designed depending on practical demands.

Please note that: the abovementioned capacitive electro-acoustic transducers 101, 201~20*n*, 301~30*n*, 311~31*n*,and 321~32*n* can be implemented by an electrostatic speaker, an electret speaker, a piezoelectric speaker, or an electret earphone. However, this should not be considered as a limitation of the present disclosure, and each transducer may be implemented by a capacitive electro-acoustic transducer of another type. Moreover, since the capacitive electro-acoustic transducers 201~20*n*, 301~30*n*, 311~31*n*, and 321~32*n* can be connected to each other by using the magnetic property of the conductive magnets, a user can connect a plurality of capacitive electro-acoustic transducers to each other with ease so as to form the capacitive electro-acoustic transducer device 200/300, and the user can also isolate the plurality of capacitive electro-acoustic transducers from each other with ease by applying a separating fore. In addition, the abovementioned audio driver 10 may be implemented by a high voltage amplifier, but the present disclosure is not limited to this only.

As can be seen from FIG. 2*a*, by connecting the plurality of capacitive electro-acoustic transducers 201~20*n* via the plurality of terminals, the plurality of capacitive electro-acoustic transducers 201~20*n* can be connected in parallel so as to form a capacitive electro-acoustic transducer array Array1. As can be seen from FIG. 3, by connecting the plurality of capacitive electro-acoustic transducers 301~30*n*, 311~31*n*, and 321~32*n* via the plurality of terminals, the plurality of capacitive electro-acoustic transducers 301~30*n*, 311~31*n*, and 321~32*n* can be connected in parallel so as to form a capacitive electro-acoustic transducer array Array2. Please also note that the abovementioned embodiments are merely a practical example for illustrating the present disclosure, and in no way should be considered as a limitation of the present disclosure. Those skilled in the art should appreciate that the number of the capacitive electro-acoustic transducers and the connecting manner of the capacitive electro-acoustic transducers are not limited, and various modifications of the capacitive electro-acoustic transducers 100, 200, or 300 may be made without departing from the spirit of the present disclosure.

Figure 4:
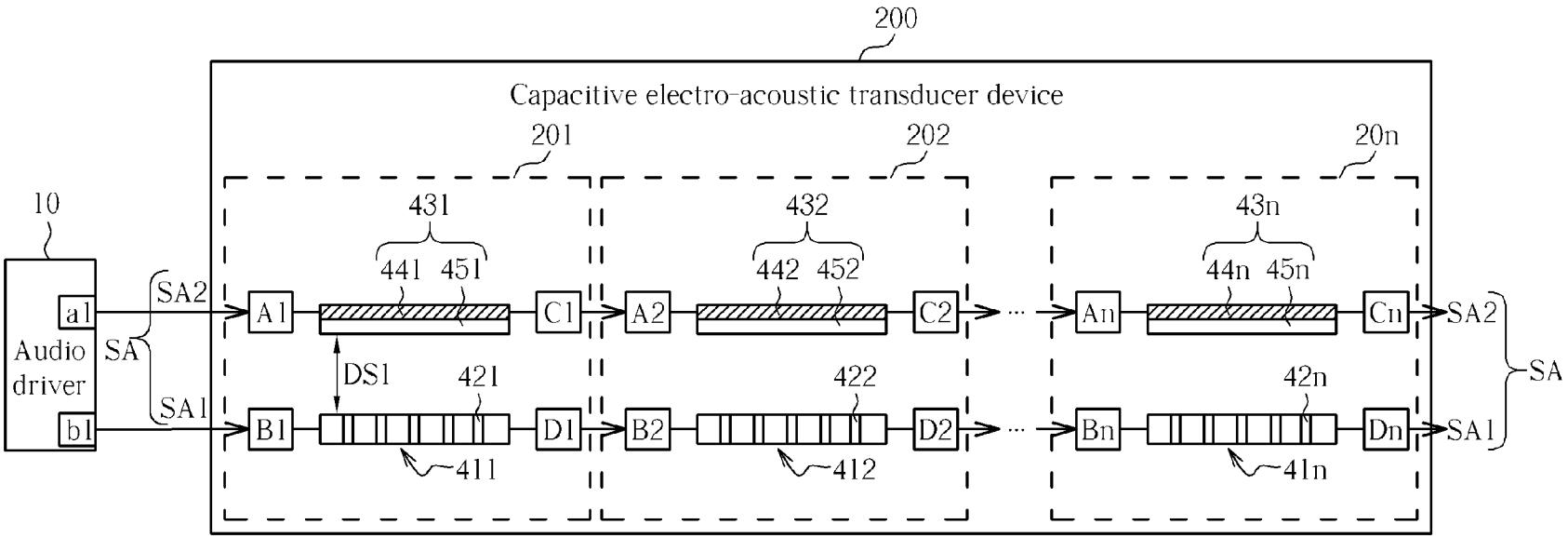
FIG. 4 is a diagram illustrating detailed components of the capacitive electro-acoustic transducer of the capacitive electro-acoustic transduction system shown in FIG. 2*a* according to a first exemplary embodiment of the present disclosure.

Please refer to FIG. 4 together with FIG. 2*a*. FIG. 4 is a diagram illustrating detailed components of the capacitive electro-acoustic transducers 201~20*n* of the capacitive electro-acoustic transducer device 200 shown in FIG. 2*a* according to a first exemplary embodiment of the present disclosure. As shown in FIG. 4, the capacitive electro-acoustic transducer device 200 includes a plurality of capacitive electro-acoustic transducers 201~20*n*. In this embodiment, each of the plurality of capacitive electro-acoustic transducers 201~20*n* may include a plurality of terminals, an electrode plate, and a diaphragm. For example, the capacitive electro-acoustic transducer 201 may include a plurality of terminals A1~D1, an electrode plate 411, and a diaphragm 431, wherein the electrode plate 411 may be composed of conductive materials or may be formed by coating a conductive layer on a non-conductive substrate, and the electrode plate 411 may have a plurality of holes 421, and the diaphragm 431 may include an electrode layer 441 and a diaphragm body 451, etc. The diaphragm 431 is disposed on one surface of the electrode plate 411 and is at a distance DS1 away from the electrode plate 411. In this embodiment, a plurality of spacers (not shown) can be disposed between the diaphragm 431 and the electrode plate 411 in order to isolate them at a distance DS1 from each other. It should be noted that: the electrode plate 411 has a first end and a second end, wherein the first end is electrically connected to the terminal B1 (i.e., a first input terminal of the pair of input terminals), and the second end is electrically connected to the terminal D1 (i.e., a first output terminal of the pair of output terminals); additionally, the diaphragm 431 has a third end and a fourth end, wherein the third end is electrically connected to the terminal A1 (i.e., a second input terminal of the pair of input terminals), and the fourth end is electrically connected to the terminal C1 (i.e., a second output terminal of the pair of output terminals).

Please note that the diaphragm body 451 can be with charges (not shown) or an additional DC bias can be applied to the electrode layer 441 (e.g., +500V or −500V), and the diaphragm body 451 can be composed of PTFE or FEP. This should not be considered as limitations of the present disclosure. The electrode layer 441 may be composed of aluminum (Al), chromium (Cr), or other conductive materials.

Since each of the plurality of capacitive electro-acoustic transducers 201~20*n* can be viewed as a capacitor, the n capacitors of the plurality of capacitive electro-acoustic transducers 201~20*n* can be connected to each other in parallel by connecting the plurality of capacitive electro-acoustic transducers 201~20*n* via the plurality of terminals.

In this embodiment, the audio signal SA outputted by the audio driver 10 maybe a pair of differential signals having a first signal SA1 and a second signal SA2, but the present disclosure is not limited to this only. The audio signal SA may be a single-ended signal or include a pair of differential signals. When the audio signal SA is a pair of differential signals, each of the electrode plates 411~41*n* of the capacitive electro-acoustic transducers 201~20*n* is configured to receive the first signal SA1 of the pair of differential signals, and each of the diaphragms 431~43*n* is configured to receive the second signal SA2 of the pair of differential signals (as is shown in FIG. 4). In other embodiments, when the audio signal SA is a single-ended signal, each of the diaphragms 431~43*n* of the capacitive electro-acoustic transducers 201~20*n* is configured to receive the single-ended signal, and each of the electrode plates 411~41*n* is coupled to ground (not shown). In this embodiment, the audio driver 10 can have two terminals a1 and b1, wherein each of the terminals a1 and b1 can be a conductive magnet with a magnetic pole (e.g., N pole or S pole), or can be formed by metal material(s) with conductivity and magnetic properties. As a result, the audio driver 10 is able to electrically connect to the terminals A1 and B1 of the capacitive electro-acoustic transducer 201 via the terminals a1 and b1, and is able to transmit the first signal SA1 and the second signal SA2 to the capacitive electro-acoustic transducers 201~20*n*.

Figure 5:
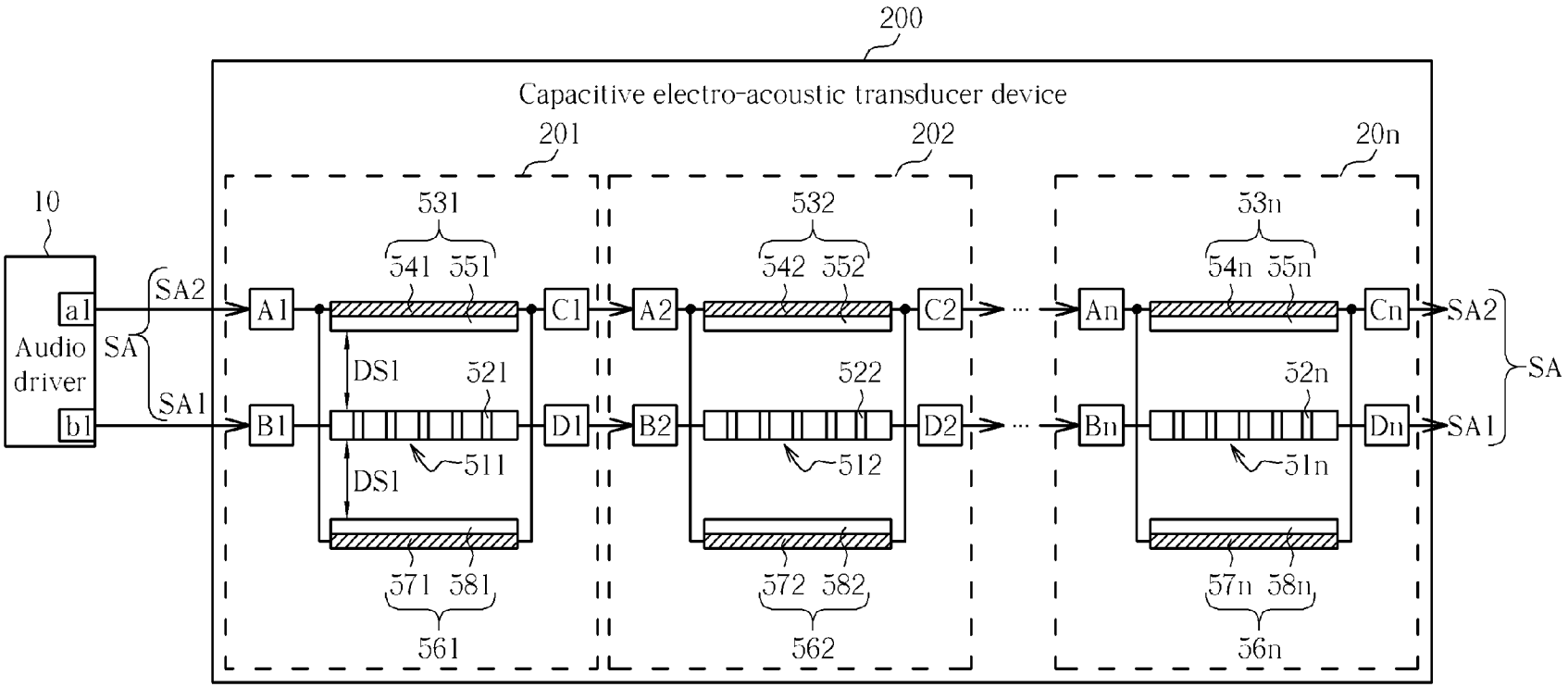
FIG. 5 is a diagram illustrating detailed components of the capacitive electro-acoustic transducer of the capacitive electro-acoustic transduction system shown in FIG. 2*a* according to a second exemplary embodiment of the present disclosure.

Please refer to FIG. 5 together with FIG. 2*a*. FIG. 5 is a diagram illustrating detailed components of the capacitive electro-acoustic transducers 201~20*n* of the capacitive electro-acoustic transducer device 200 shown in FIG. 2*a* according to a second exemplary embodiment of the present disclosure. As shown in FIG. 5, the capacitive electro-acoustic transducer device 200 includes a plurality of capacitive electro-acoustic transducers 201~20*n*. In this embodiment, each of the plurality of capacitive electro-acoustic transducers 201~20*n* may include a plurality of terminals, an electrode plate, a first diaphragm, and a second diaphragm, wherein the first diaphragm is disposed on one side of the electrode plate and the second diaphragm is disposed on another side of the electrode plate. For example, the capacitive electro-acoustic transducer 201 may include a plurality of terminals A1~D1, an electrode plate 511, a first diaphragm 531, and a second diaphragm 561, wherein the electrode plate 511 may be composed of conductive materials or may be formed by coating a conductive layer on a non-conductive substrate, the electrode plate 511 may have a plurality of holes 521, and the first diaphragm 531 may include an electrode layer 541 and a diaphragm body 551, and the second diaphragm 561 may include an electrode layer 571 and a diaphragm body 581, etc. The first diaphragm 531 and the second diaphragm 561 are respectively disposed on two opposite surfaces of the electrode plate 511 and are respectively at a distance DS1 away from the electrode plate 511. In this embodiment, a plurality of spacers (not shown) can be disposed between the first diaphragm 531 and the electrode plate 511 in order to isolate them at a distance DS1 away from each other, and a plurality of spacers (not shown) can be disposed between the second diaphragm 561 and the electrode plate 511 in order to isolate them at a distance DS1 away from each other. It should be noted that: the electrode plate 511 has a first end and a second end, wherein the first end is electrically connected to the terminal B1 (i.e., a first input terminal of the pair of input terminals), and the second end is electrically connected to the terminal D1 (i.e., a first output terminal of the pair of output terminals); additionally, the electrode layer 541 of the first diaphragm 531 has a third end and a fourth end, and the electrode layer 571 of the second diaphragm 561 has a fifth end and a sixth end, wherein the third end and the fifth end are electrically connected to the terminal A1 (i.e., a second input terminal of the pair of input terminals), and the fourth end and the sixth end are electrically connected to the terminal C1 (i.e., a second output terminal of the pair of output terminals).

Since each of the plurality of capacitive electro-acoustic transducers 201~20*n* can be viewed as two capacitors, the 2*n* capacitors of the plurality of capacitive electro-acoustic transducers 201~20*n* can be connected to each other in parallel by connecting the plurality of capacitive electro-acoustic transducers 201~20*n* via the plurality of terminals.

Similarly, in this embodiment, when the audio signal SA is a pair of differential signals, the electrode plate (such as, 511) of the capacitive electro-acoustic transducer (such as, 201) is configured to receive the first signal SA1 of the pair of differential signals, and the first diaphragm (such as, 531) and the second diaphragm (such as, 561) are configured to receive the second signal SA2 of the pair of differential signals (as is shown in FIG. 5). In other embodiments, when the audio signal SA is a single-ended signal, the first diaphragm (such as, 531) and the second diagram (such as, 561) of the capacitive electro-acoustic transducer (such as, 201) is configured to receive the single-ended signal, and the electrode plate (such as, 511) is coupled to ground (not shown). In this embodiment, the audio driver 10 can have two terminals a1 and b1, wherein each of the terminals a1 and b1 can be a conductive magnet with a magnetic pole (e.g., N pole or S pole), or can be formed by metal material(s) with conductivity and magnetic properties. As a result, the audio driver 10 is able to electrically connect to the terminals A1 and B1 of the capacitive electro-acoustic transducer 201 via the terminals a1 and b1, and is able to transmit the first signal SA1 and the second signal SA2 to the capacitive electro-acoustic transducers 201~20*n*.

The abovementioned embodiments are presented merely for describing the present disclosure, and in no way should be considered to be limitations of the scope of the present disclosure. In summary, the present disclosure provides a capacitive electro-acoustic transducer system/device and its audio connecting manner. By using the conductivity and the magnetic attraction of conductive magnets, audio signals can be transmitted between a plurality of capacitive electro-acoustic transducers. In addition, the plurality of capacitive electro-acoustic transducers can be connected in parallel so as to form a capacitive electro-acoustic transducer array. Therefore, not only can the output volume of the capacitive electro-acoustic transducer device be improved, but also a full-range audio output can be produced by connecting a plurality of capacitive electro-acoustic transducers with different frequency responses to each other and by using a full-range audio amplifier to drive the capacitive electro-acoustic transducer array. Please note that each terminal of the plurality of terminals can selectively be used as an input terminal or an output terminal, which brings more convenience to the user. Additionally, each capacitive electro-acoustic transducer of the capacitive electro-acoustic transducer device disclosed in the present disclosure can be implemented by adopting a single diaphragm or two diaphragms, which also belongs to the scope of the present disclosure.

Those skilled in the art will readily observe that numerous modifications and alterations of the device and method may be made while retaining the teachings of the invention.

What is claimed is:

1. A capacitive electro-acoustic transducer, comprising:

a pair of input terminals and a pair of output terminals, the pair of input terminals used for receiving an audio signal and the pair of output terminals used for outputting the audio signal, wherein at least one terminal of the pair of input terminals and the pair of output terminals is a conductive magnet;

an electrode plate, comprising a first end and a second end, wherein the first end is electrically connected to a first input terminal of the pair of input terminals, and the second end is electrically connected to a first output terminal of the pair of the output terminals; and a diaphragm, disposed on a first side of the electrode plate and comprising a third end and a fourth end, wherein the third end is electrically connected to a second input terminal of the pair of input terminals, and the fourth end is electrically connected to a second output terminal of the pair of the output terminals.

2. The capacitive electro-acoustic transducer according to claim 1, wherein each terminal of the pair of input terminals and the pair of output terminals is a conductive magnet.

3. The capacitive electro-acoustic transducer according to claim 2, wherein each of the first input terminal and the second input terminal is a conductive magnet with a first magnetic pole, and each of the first output terminal and the second output terminal is a conductive magnet with a second magnetic pole different from the first magnetic pole.

4. The capacitive electro-acoustic transducer according to claim 1, further comprising:

a second diaphragm, disposed on a second side of the electrode plate and comprising a fifth end and a sixth end, wherein the fifth end is electrically connected to the second input terminal of the pair of input terminals, and the sixth end is electrically connected to the second output terminal of the pair of output terminals.

5. The capacitive electro-acoustic transducer according to claim 1, further comprising a plurality of spacers disposed between the diaphragm and the electrode plate.

6. The capacitive electro-acoustic transducer according to claim 1, wherein the diaphragm comprises a diaphragm body and an electrode layer; and the electrode layer comprises the third end electrically connected to the second input terminal of the pair of input terminals and the fourth end electrically connected to the second output terminal of the pair of output terminals.

7. The capacitive electro-acoustic transducer according to claim 1, wherein the audio signal is a single-ended signal, the diaphragm is configured to receive the single-ended signal, and the electrode plate is coupled to ground.

8. The capacitive electro-acoustic transducer according to claim 1, wherein the audio signal includes a pair of differential signals, the electrode plate is configured to receive a first signal of the pair of differential signals, and the diaphragm is configured to receive a second signal of the pair of differential signals.

9. The capacitive electro-acoustic transducer according to claim 1, wherein the capacitance electro-acoustic transducer is an electrostatic speaker, an electret speaker, a piezoelectric speaker, or an electret earphone.

10. A capacitive electro-acoustic transduction system, comprising:

an audio driver, configured to output an audio signal; and a first capacitive electro-acoustic transducer and a second capacitive electro-acoustic transducer, each comprising:

a pair of input terminals and a pair of output terminals, the pair of input terminals used for receiving the audio signal and the pair of output terminals used for outputting the audio signal, wherein at least one terminal of the pair of input terminals and the pair of output terminals is a conductive magnet;

an electrode plate, comprising a first end and a second end, wherein the first end is electrically connected to a first input terminal of the pair of input terminals, and the second end is electrically connected to a first output terminal of the pair of the output terminals; and a first diaphragm, disposed on a first side of the electrode plate and comprising a third end and a fourth end, wherein the third end is electrically connected to a second input terminal of the pair of input terminals, and the fourth end is electrically connected to a second output terminal of the pair of the output terminals;

wherein the pair of input terminals of the first capacitive electro-acoustic transducer is electrically connected to the audio driver for receiving the audio signal, and the pair of output terminals of the first capacitive electro-acoustic transducer is electrically connected to the pair of input terminals of the second capacitive electro-acoustic transducer via the magnetic attraction of the conductive magnet.

11. The capacitive electro-acoustic transduction system according to claim 10, wherein each of the first capacitive electro-acoustic transducer and the second capacitive electro-acoustic transducer further comprises:

a second diaphragm, disposed on a second side of the electrode plate and comprising a fifth end and a sixth end, wherein the fifth end is electrically connected to the second input terminal of the pair of input terminals, and the sixth end is electrically connected to the second output terminal of the pair of output terminals.

12. The capacitive electro-acoustic transduction system according to claim 10, wherein each terminal of the pair of input terminals and the pair of output terminals of the first capacitive electro-acoustic transducer and the second capacitive electro-acoustic transducer is a conductive magnet.

13. The capacitive electro-acoustic transduction system according to claim 12, wherein each of the first input terminal and the second input terminal is a conductive magnet with a first magnetic pole, and each of the first output terminal and the second output terminal is a conductive magnet with a second magnetic pole different from the first magnetic pole.

14. The capacitive electro-acoustic transduction system according to claim 11, wherein each of the first diaphragm and the second diaphragm comprises a diaphragm body and an electrode layer; the electrode layer of the first diaphragm comprises the third end electrically connected to the second input terminal of the pair of input terminals and the fourth end electrically connected to the second output terminal of the pair of output terminals; and the electrode layer of the second diaphragm comprises the fifth end electrically connected to the second input terminal of the pair of input terminals and the sixth end electrically connected to the second output terminal of the pair of output terminals.

15. The capacitive electro-acoustic transduction system according to claim 10, wherein the audio signal is a single-ended signal, the first diaphragm is configured to receive the single-ended signal, and the electrode plate is coupled to ground.

16. The capacitive electro-acoustic transduction system according to claim 10, wherein the audio signal includes a pair of differential signals, the electrode plate is configured to receive a first signal of the pair of differential signals, and the first diaphragm is configured to receive a second signal of the pair of differential signals.

17. The capacitive electro-acoustic transduction system according to claim 10, wherein the capacitance electro-acoustic transducer is an electrostatic speaker, an electret speaker, a piezoelectric speaker, or an electret earphone.

* * * * *